US006188865B1

(12) United States Patent
Kopp

(10) Patent No.: US 6,188,865 B1
(45) Date of Patent: Feb. 13, 2001

(54) PRINTER OR COPIER IMAGE FIXING STATION WITH GUIDE YOKE HAVING LOW-WEAR DEFLECTOR EDGE

(75) Inventor: Walter Kopp, Taufkirchen (DE)

(73) Assignee: Océ Printing Systems GmbH, Poing (DE)

( * ) Notice: Under 35 U.S.C. 154(b), the term of this patent shall be extended for 0 days.

(21) Appl. No.: 09/454,002

(22) Filed: Dec. 3, 1999

Related U.S. Application Data

(63) Continuation of application No. 09/029,692, filed on Jun. 12, 1998, now abandoned.

(51) Int. Cl.[7] ..... G03G 15/20
(52) U.S. Cl. ..... 399/400
(58) Field of Search ..... 399/122, 320, 399/328, 381, 384, 335, 400, 322; 219/216; 225/24–25, 42, 44

(56) References Cited

U.S. PATENT DOCUMENTS

| | | | |
|---|---|---|---|
| 4,401,385 | 8/1983 | Katayama et al. . | |
| 5,159,394 | 10/1992 | Jinzai . | |
| 5,166,736 | 11/1992 | Ogawa et al. . | |
| 5,491,545 | 2/1996 | Kopp et al. . | |
| 5,495,324 | 2/1996 | Kopp . | |
| 5,546,178 | 8/1996 | Manzer et al. . | |
| 5,568,245 | 10/1996 | Ferber et al. . | |
| 5,752,153 | 5/1998 | Kreiter et al. . | |
| 5,758,227 * | 5/1998 | Kopp | 399/69 |

FOREIGN PATENT DOCUMENTS

| | | |
|---|---|---|
| 42 35 668 A1 | 4/1994 | (DE) . |
| 0 572 050 A2 | 12/1993 | (EP) . |
| 1-164975 | 6/1989 | (JP) . |
| WO 94/27193 | 11/1994 | (WO) . |

OTHER PUBLICATIONS

Japanese Abstract, JP59036274, Publication Date: Feb. 28, 1984.

* cited by examiner

*Primary Examiner*—Quana M. Grainger
(74) *Attorney, Agent, or Firm*—Schiff Hardin & Waite

(57) ABSTRACT

A printer or copier device has a developer station with fixing drums for fixing the toner image on the recording medium. A guide yoke guides the recording medium to the fixing drums. The guide yoke includes a deflector edge over which the recording medium is fed. The deflector is replaceable and is formed of wear-resistant material in the region that contacts the recording medium. The deflector edge may include a deflector element with a plurality of deflection edges and which can be rotated to expose different edges.

10 Claims, 2 Drawing Sheets

PRINTER OR COPIER IMAGE FIXING STATION WITH GUIDE YOKE HAVING LOW-WEAR DEFLECTOR EDGE

CROSS-REFERENCE TO RELATED APPLICATION

The present application is a Continuation Application of U.S. patent application Ser. No. 09/029,692, filed Jun. 12, 1998 now abandon.

BACKGROUND OF THE INVENTION

1. Field of the Invention

The present invention is directed generally to a fixing means for fixing toner images on a web-shaped recording medium in a printer or copier device.

2. Description of the Related Art

A fixing means of said species is disclosed by German Patent Document DE-C2 4235668. It contains a guide yoke with a deflector edge over which the recording medium is supplied to the actual fixing region.

On the one hand, this guide yoke can serve for heating the recording medium; on the other hand, it stabilizes the recording medium as it is running through the printer. In the print mode, the recording medium slides over the sliding surface of the yoke and over the deflector edge. The deflector edge is thereby subject to significantly higher wear than the sliding surface. When the deflector edge is worn, this leads to an imprecise delivery of the recording medium to the following fixing region, which significantly degrades the fixing quality and, thus, the printing quality. In case of wear, the entire guide yoke must be replaced. This is involved and causes an undesired, long interruption of the print mode or, respectively, necessitates a re-adjustment of the entire fixing station.

SUMMARY OF THE INVENTION

It is therefore an object of the invention to provide a fixing means of a printer or copier device such that wear, particularly wear occurring in the region of the deflector edge of the guide yoke, can be corrected in the shortest time without replacing the entire guide yoke.

This and other objects and advantages of the invention are achieved by a fixing means for fixing toner images on a web-shaped recording medium in a printer or copier device having a thermal fixing region comprising fixing drums and having a guide yoke, that is swivellable as needed, preceding the thermal fixing region in the running direction of the recording medium whose end facing toward the thermal fixing region comprises a deflector edge over which the recording medium is supplied to the thermal fixing region, the deflector edge being replaceably fashioned and being composed of highly wear-resistant material, at least in the contacting region with the recording medium.

An additional feature of the invention provides that the deflector edge is composed of a plurality of individual deflector elements. The deflector edge comprises at least one cylindrical element that is releasably secured in a holder of the guide yoke, and may provide that the holder accepts the deflector element rotatable around its longitudinal axis and is fixable. Preferably, the highly wear-resistant material is composed of steel with a nitrated surface.

The end of the guide yoke comprises a receptacle channel for the acceptance of the deflector edge. The fixing means of one embodiment is designed for the acceptance of two recording medium webs conducted over the guide yoke side-by-side.

The discharge region of the guide yoke accepting the deflector edge comprises a sliding surface for the recording medium, the sliding surface being conducted on a straight surface and terminating tangentially with the deflector edge.

The guide yoke is an unheated, swivellable yoke carrying a sliding surface for the recording medium or media. Alternately, the guide yoke is fashioned as a heated, swivellable preheating yoke carrying a sliding surface for the recording medium or media.

The deflector edge is fashioned so as to be interchangeable and is composed of a highly wear-resistant material at least in the contact region with the recording medium, so that a complete replacement of the deflector yoke is eliminated in case of wear. Long operating interruptions of the printer device are thereby avoided. An involved readjustment of the fixing station is eliminated.

In an advantageous embodiment, the deflector edge is composed of a surface-hardened steel shaft that is arranged so as to be rotationally fixable in a receptacle channel at the end of the guide yoke. By simply releasing the holder, the steel shaft can be turned in case of wear, and a new, unused region can thus be brought into contact with the recording medium. The original condition is thus restored without readjustment.

BRIEF DESCRIPTION OF THE DRAWINGS

Embodiments of the invention are shown in the drawings and are described in greater detail below by way of example.

DETAILED DESCRIPTION OF THE PREFERRED EMBODIMENTS

Figure 1:
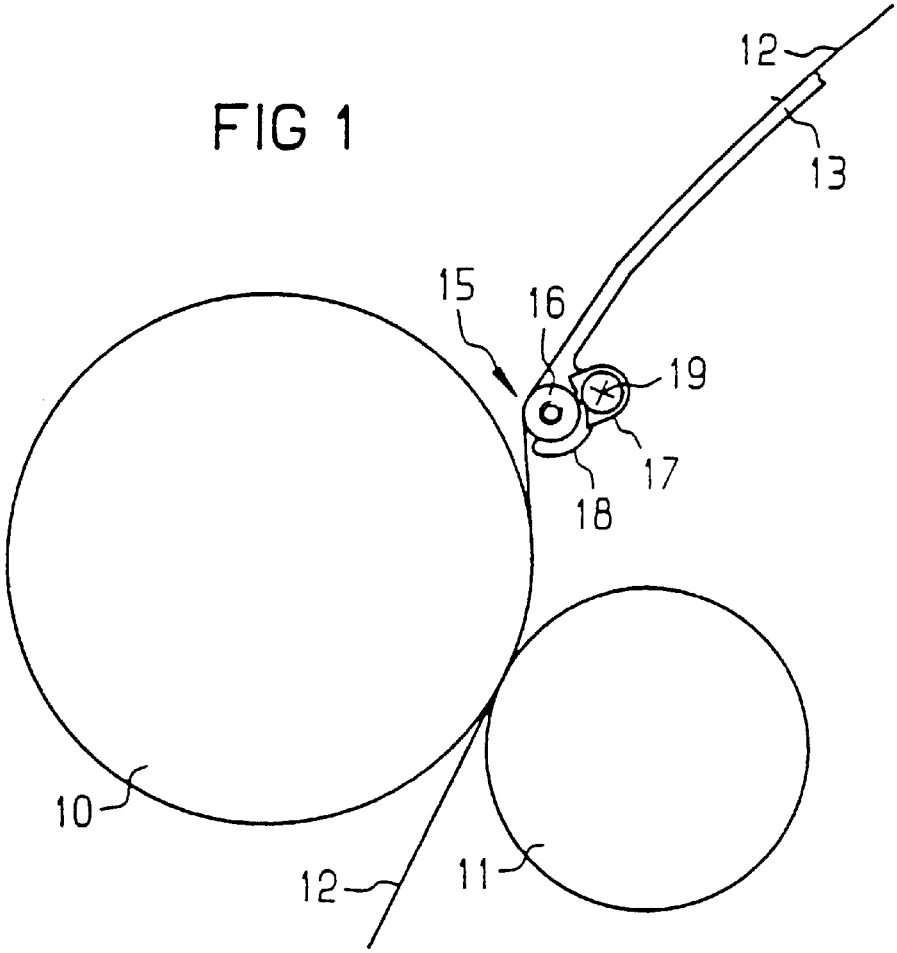
FIG. 1 is a schematic side view of a fixing station with unheated swivel yoke comprising a replaceable deflector edge.
Figure 2:
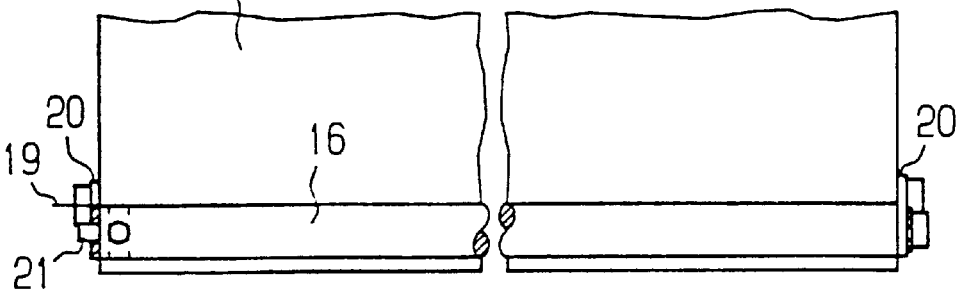
FIG. 2 is a plan view of the region of the replaceable deflector edge of the fixing station of FIG. 1.

An electrographic printer device for printing web-shaped recording media with differing web width, as disclosed by published PCT Application WO 94/27193, contains a thermal fixing station shown in FIGS. 1 and 2. The thermal fixing station is designed for the acceptance of two recording medium webs which are guided side-by-side and that are coupled via a turnover means. Duplex printing on a continuous stock web is thus possible, whereby a front side toner image is fixed on the paper web in the first pass through the fixing station and, after deflection, a back side toner image is fixed on the paper web in the second, parallel pass.

The fixing station is essentially composed of a heated fixing drum 10 having a pressure roller 11 that can be swivelled in against and out away from the fixing drum 10 between which the recording medium 12 is conducted. A toner image adhering to the surface of the recording medium 12 is fixed by pressure and heat in the fixing gap between the drums 10 and roller 11 in a known way. A swivellable guide yoke 13 preceding the drums 10 and 11 in a running direction of the recording medium serves the purpose of delivering the paper web 12 (recording medium) to the fixing gap between the drums. Since the paper web 12 can already carry a fixed toner image on its back side, the guide yoke 13 is unheated. Before the actual passage through the fixing gap, the paper web 13 with the toner image to be fixed is conducted around the fixing drum 10 at a wrap angle for pre-heating. The paper web 12 thereby initially slides over a polished, potentially PTFE-coated sliding surface 14 of the guide yoke 13, which is composed of steel, and is deflected in the region of a deflector edge 15. In order to assure an exact guidance of the paper web 12, the guide yoke 13 is slightly buckled in the discharge region, so that the paper web 12 is supplied to the deflector edge 15 on a straight line and running smoothly. In the illustrated exemplary embodiment, the guide yoke is composed of a steel shaft 16 with a nitrated, hardened surface having a diameter of 10 mm that extends over the width of the guide yoke 13. Via a holder 17, it is replaceably arranged in an exact-fit receptacle channel 18 in the discharge region of the guide yoke 13. Two lateral brackets 20 releasably secured to the guide yoke 13 via fastening screws 19 serve as a holder that seats the steel shaft 16 in the receptacle channel 18. The steel shaft 16 is in turn fixed on one of the brackets via a fastening screw so as to be rotation proof. The steel shaft is rotation proof because the steel shaft 16, with its small radius, also serves as a smoothing edge for the paper web 12. In the case of wear, the fastening screw 21 at the steel shaft 16 is loosened and the shaft 16 is turned by approximately 45°. Up to eight wear cycles can be used in this way. If this proves inadequate for the service life of the device, the steel shaft 16 can be easily replaced by releasing a fastening bracket 20.

The arrangement of an interchangeable rod, of a ledge, of a sheet metal rail or similar deflection means with a highly wear-resistant surface as a deflector edge is also conceivable instead of a steel shaft 16. Further, a plurality of individual deflector edges of the disclosed type can be arranged next to one another instead of a continuous deflector edge.

Figure 3:
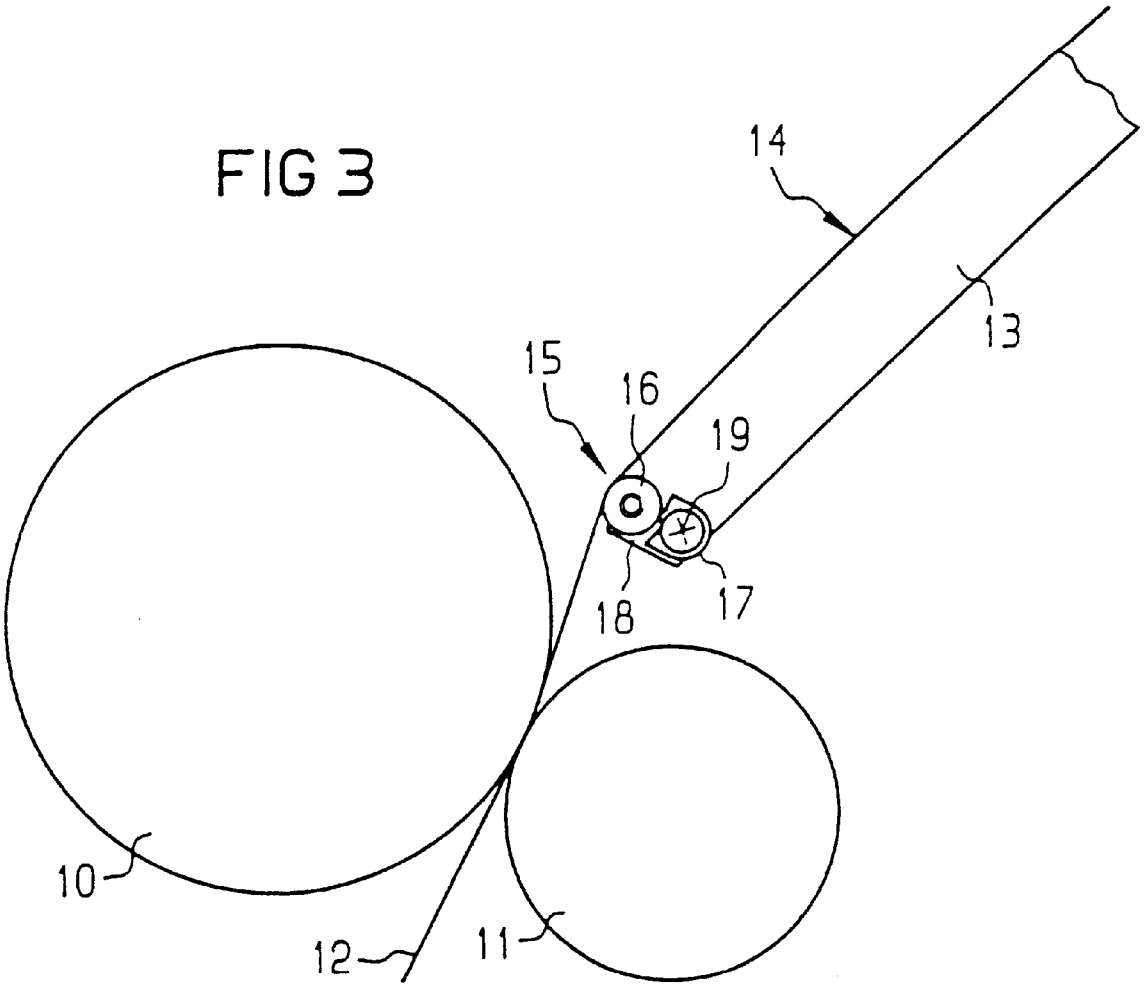
FIG. 3 is a schematic side view of a fixing station with heated swivel yoke comprising a replaceable deflector edge.
Figure 4:
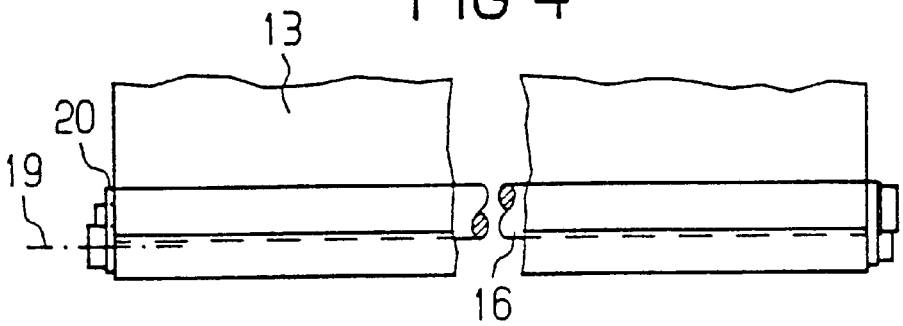
FIG. 4 is a plan view of the region of the replaceable deflector edge of the fixing station of FIG. 3.

In the exemplary embodiment of FIGS. 3 and 4, the guide yoke 13 is composed of a pre-heating yoke with heating elements integrated therein, as disclosed in detail in German Patent Document DE-C2-4235668. Here, too, a steel shaft 16 secured rotationally fixable in an exact-fit-receptacle channel 18 of the guide yoke 13 via a holder 17 is employed as deflector edge. In the simplex mode, the paper web 12 carrying the toner images is pre-heated with the pre-heating yoke 16 in a known way before the actual fixing in the fixing gap.

Although other modifications and changes may be suggested by those skilled in the art, it is the intention of the inventor to embody within the patent warranted hereon all changes and modifications as reasonably and properly come within the scope of his contribution to the art.

What is claimed is:

1. A fixing apparatus and guide yoke for fixing toner images on a web-shaped recording medium in a printer or copier device, comprising:

a thermal fixing region including fixing drums and a guide yoke preceding the thermal fixing region in a running direction of the web-shaped recording medium whose end facing toward the thermal fixing region includes a deflector edge over which the web-shaped recording medium is supplied to the thermal fixing region, said deflector edge being in contact with the web-shaped recording medium at a contact region at least a portion of a time when said the web-shaped recording medium is being supplied to the thermal fixing region, said deflector edge being replaceably mounted and is composed of highly wear-resistant material, at least in a contacting region with the web-shaped recording medium, and a swivellable mounting which mounts said guide yoke preceding the thermal fixing direction, said swivellable mounting permitting said guide yoke to be swivelled as needed.

2. A fixing apparatus and guide yoke according to claim 1, wherein said deflector edge comprises a single deflector element.

3. A fixing apparatus and guide yoke according to claim 1, further comprising:

a holder for removably holding said guide yoke, and wherein said deflector edge includes at least one cylindrical element that is releasably secured in said holder of the guide yoke.

4. A fixing apparatus and guide yoke according to claim 3, wherein said holder accepts said at least one cylindrical element so that said deflector is rotatable around its longitudinal axis and selectively fixable so as to be non-rotatable.

5. A fixing apparatus and guide yoke according to claim 1, wherein the highly wear-resistant material is steel with a nitrated surface.

6. A fixing apparatus and guide yoke according to claim 1, wherein said guide yoke includes an end having a receptacle channel for accepting said deflector edge.

7. A fixing apparatus and guide yoke according to claim 1, wherein said thermal fixing region and said guide yoke are of a width capable of accepting said web-shaped recording medium and a further web-shaped recording medium conducted over the guide yoke side-by-side.

8. A fixing apparatus and guide yoke according to claim 1, wherein said guide yoke includes a discharge region for accepting said deflector edge, said discharge region including a sliding surface for the web-shaped recording medium, said sliding surface being a straight surface and terminating tangentially with the deflector edge.

9. A fixing apparatus and guide according to claim 1, wherein said guide yoke is an unheated, swivellable yoke carrying a sliding surface for the web-shaped recording medium.

10. A fixing apparatus and guide yoke according to claim 1, wherein said guide yoke includes a heat source to provide a heated, swivellable preheating yoke carrying a sliding surface for the web-shaped recording medium.

* * * * *